US005542124A

United States Patent [19]

Grilliot et al.

[11] Patent Number: 5,542,124

[45] Date of Patent: Aug. 6, 1996

[54] FIREFIGHTERS COAT HAVING A PARTIALLY REMOVABLE LINER

[75] Inventors: William L. Grilliot; Mary I. Grilliot, both of Dayton, Ohio

[73] Assignee: Morning Pride, Dayton, Ohio

[21] Appl. No.: 372,590

[22] Filed: Jan. 13, 1995

Related U.S. Application Data

[63] Continuation of Ser. No. 185,447, Jan. 24, 1994, abandoned, which is a continuation of Ser. No. 911,856, Jul. 10, 1992, abandoned.

[51] Int. Cl.[6] ..... A41D 13/00

[52] U.S. Cl. ..... 2/81; 2/86; 2/97

[58] Field of Search ..... 2/69, 79, 81, 82, 2/85, 86, 87, 93, 97, 108, 227, 272, 115, 125, 231, 232, 243 R

[56] References Cited

U.S. PATENT DOCUMENTS

| | | | |
|---|---|---|---|
| 1,085,791 | 2/1914 | Berkenfeld | 2/93 |
| 1,490,470 | 4/1924 | Laubach | 2/227 |
| 2,313,519 | 3/1943 | Cuttler | 2/97 |
| 2,702,387 | 2/1955 | Wenzel | 2/97 |
| 2,746,057 | 5/1956 | Breier | 2/97 |
| 4,543,670 | 10/1985 | Ehring | 2/85 |
| 4,631,753 | 12/1986 | Ehring | 2/85 |
| 4,782,534 | 11/1988 | Grilliot | 2/81 |
| 4,941,213 | 7/1990 | Grilliot | 2/232 |
| 4,993,077 | 2/1991 | Robison | 2/79 |
| 5,095,549 | 3/1992 | Aldridge | 2/81 |
| 5,127,106 | 7/1992 | Aldridge | 2/81 |
| 5,131,098 | 7/1992 | Grilliot | 2/81 |
| 5,136,724 | 8/1992 | Grilliot | 2/79 |
| 5,138,717 | 8/1992 | Tolton | 2/82 |

FOREIGN PATENT DOCUMENTS

| | | | |
|---|---|---|---|
| 1323714 | 3/1963 | France | 2/87 |
| 1240203 | 7/1971 | United Kingdom | 2/272 |

*Primary Examiner*—Diana Biefeld
*Attorney, Agent, or Firm*—Rockey, Rifkin and Ryther

[57] ABSTRACT

The present invention relates to a protective garment, such as for example that worn by a firefighter and the like.

The garment of the present invention in its broadest terms comprises (a) an outer layer comprising at least one terminal edge (i.e. such as on the garment hemlines, collar, closure edges and sleeve ends), with a minor portion adjacent the terminal edge(s), and a major portion; and (b) an inner layer, divided into a major portion and a minor portion, with the minor portion of the inner layer permanently affixed beneath the minor portion of the outer layer and along the terminal edge(s) (or portions thereof) of the outer layer; and major portion of the inner layer permanently or removably attached beneath the major portion of the outer layer. In this regard, it is desireable to maintain the major portion inner layer(s) of a firefighting garment unbound to terminal ends of the outer layer so that it may more easily shed water, soil and contaminants.

7 Claims, 2 Drawing Sheets

Fig. 1
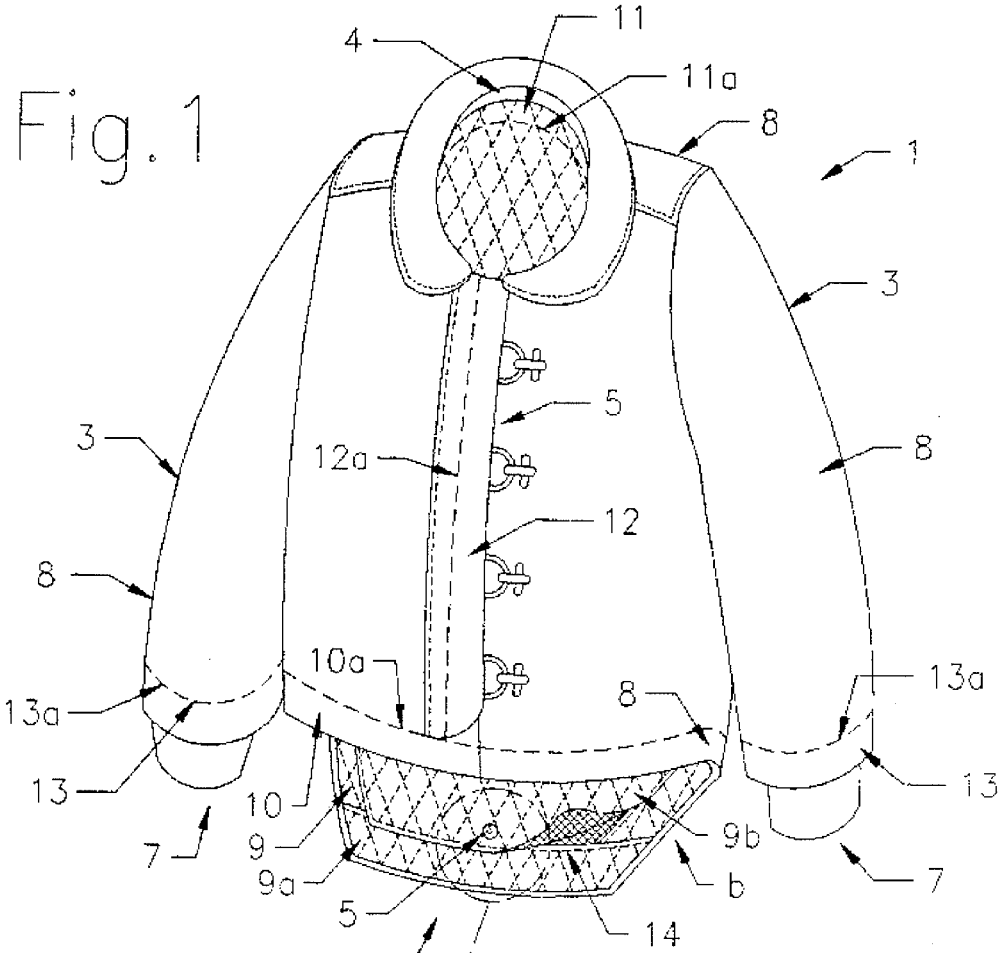
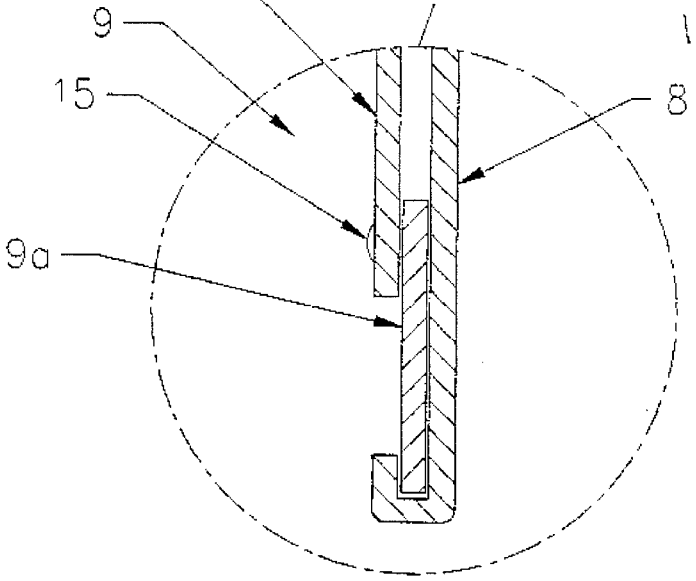
Fig. 2

Fig. 3
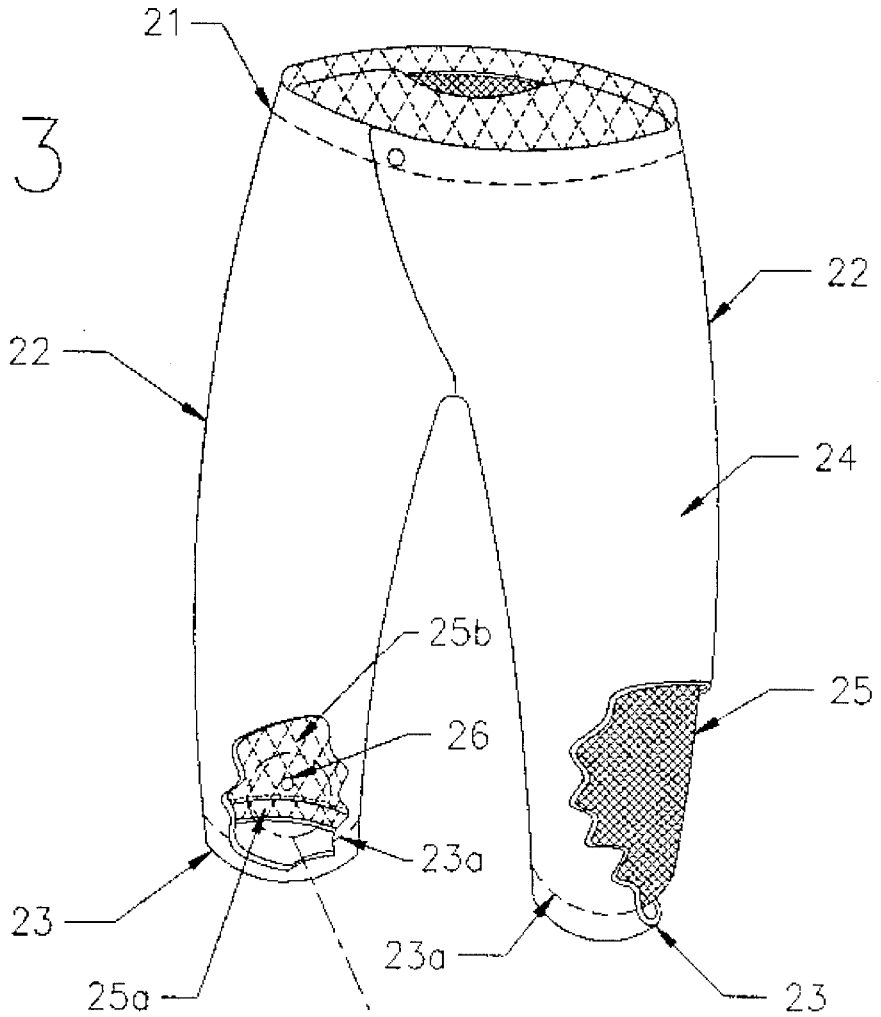
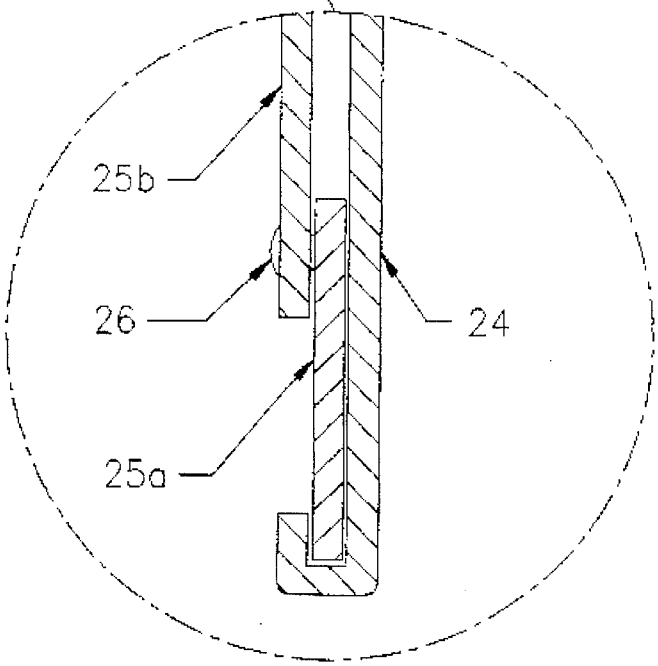
Fig. 4

FIREFIGHTERS COAT HAVING A PARTIALLY REMOVABLE LINER

This is a continuation of application Ser. No. 08/185,447 filed on Jan. 24, 1994, which is a continuation of Ser. No. 07/911,856 filed on Jul. 10, 1992, both of which are now abandoned.

BACKGROUND

In multi-layered protective garments, such a those used by firefighter's and the like, several problems have been experienced in having the inner layers cooperate with the outer shell material to provide full composite protection.

In the case of firefighter's garments, such garments are normally constructed of an outer layer or "shell" material. The outer shell materials are generally constructed of sturdy, abrasion resistant and flame-resistant materials adapted to wear well not withstanding exposure to abrasion, moisture, heat and flame.

The inner layer, beneath the outer shell, is normally of at least one insulative and/or moisture barrier material. These materials are generally not as sturdy and wear resistant. At the terminal edges of the garment portions, such as at the coat tails, sleeve ends, trouser ends, or waist bands, these materials can be exposed to abrasion, moisture, and heat. These effects cause accelerated deterioration of the material.

Because only the full composite (i.e., the outer shell, a liquid proof moisture barrier and a thermal liner) offers true protection, industry standards specifically require that the moisture barrier and thermal insulative liner extend to within three inches of the terminal edges of the outer shell. Designers of these type garments must therefore concern themselves with the full composite overlap rather than just with the length of the outer shell.

Accordingly, the outer shell material is often made up to three inches longer than is needed for overlap protection, as the interior layers can be up to three inches shorter. Although one solution might be to have the interior layers simply be coextensive with the outer shell, this may cause the inner layers to extend beyond the outer shell during use, or otherwise be vulnerable to the degrading effects in the firefighting environment. The affects of heat, moisture or liquid containment, abrasion, and soiling can quickly result in degradation or destruction of the inner layer materials, rendering the entire garment incapable of continuing to provide adequate overlapping full composite protection.

Another problem with these systems has been that the permanently attached liners cannot readily be cleaned or repaired. In the case where portions of the liner are degraded by the effects described above, this results in the entire liner and enhanced the entire garment being rendered incapable of providing overlap protection throughout the entire area covered by the garment. For instance, the inner liner may be exposed to water or liquid containment which, by capillary action or "wicking", can travel from the garment edges to the interior portions of water-borne soil to extended portions of the liner. This can adversely affect comfort by allowing moisture into the garment rendering the interior wetter and the garment heavier as a whole.

Because current firefighter garment designs include an outer shell of material that extends beyond the inner layer materials, this design adds unnecessary weight and expense to the entire firefighter garment system. Typical outer shell materials can be as expensive as $40.00 per yard.

It is therefore an object of the present invention to provide a multi-layer protective garment which provides full overlap protection throughout the area covered by the garment.

It is also an object of the present invention to provide a multi-layered protective garment which will reduce the amount of outer shell material necessary to the production of the garment, thereby reducing its weight and expense.

It is a further object of one embodiment of the present invention to provide a multi-layered protective garment whose inner layer material(s) may be removed for repair or cleaning.

Yet another object of the present invention is to provide a multi-layered protective garment whose entire inner layer material(s) are not subject to degradation or destruction through exposure to the degrading effects present in a firefighter's environment.

It should be understood that while some of the advantages of the protective garment of the present invention are described in terms of a firefighter's garment, the protective garment of the present invention is not limited to use in firefighting. Rather, it may be used for protection against similarly hostile environments.

SUMMARY OF THE INVENTION

The present invention relates to a protective garment, such as for example that worn by a firefighter and the like.

The garment of the present invention in its broadest terms comprises (a) an outer layer comprising at least one terminal edge (i.e. such as on the garment hemlines, collar, closure edges and sleeve ends), with a minor portion adjacent the terminal edge(s), and a major portion; and (b) an inner layer, divided into a major portion and a minor portion, with the minor portion of the inner layer permanently affixed beneath the minor portion of the outer layer and along the terminal edge(s) (or portions thereof) of the outer layer; and major portion of the inner layer permanently or removably attached beneath the major portion of the outer layer. In this regard, it is desireable to maintain the major portion inner layer(s) of a firefighting garment unbound to terminal ends of the outer layer so that it may more easily shed water, soil and contaminants.

Typically, the width of the minor portion of the inner layer is in the range of from about 0.1 to about 6 inches.

The construction of the garment may be of any material(s) appropriate for the garment's intended use. For firefighting purposes, the garment should meet NFPA guidelines 1500 and 1971. To this end, the outer layer of the garment is normally of a flame resistant and abrasion resistant material in accordance with such as, for instance, Nomex Duck, commercially available from DuPont Corporation of Delaware. The inner layer generally comprises a liquid-proof moisture barrier material (such as Goretex) and a thermal insulative material (such as Batt Nomex), typically stitched to the moisture barrier material.

The minor portion of the inner layer is permanently attached by to the outer layer by any means appropriate to the intended use and the fabrics involved. Such means will be known by those skilled in the art and include stitching and attachment by use of adhesives.

The major portion of the inner layer is releasably attached to the outer layer by any means appropriate to the intended use and the fabrics involved. Such means will be known by those skilled in the art and include snaps, buttons, velcro closures, zippers and attachment by releasable adhesive.

The garment of the present invention may include a jacket having a torso portion, with or without arm portions. Where the garment includes a jacket having a torso portion having: (1) a bottom edge, and (2) arm portions having end edges; the terminal edge(s) may be the ends of the arm portions, the bottom edge of the torso portion. Where the garment is without arm portions, the terminal edge may be the arm opening edges.

A garment according to the present invention may also include a trousers portion. Where the garment includes a pair of trousers having two leg portions each having an end edge, the terminal edge(s) may be the end edges of the leg portions.

DESCRIPTION OF THE DRAWINGS

FIG. 1 is a front elevation view of a jacket in accordance with one embodiment of the present invention.

FIG. 2 is a detailed cross-sectional view of a portion of the jacket shown in FIG. 1.

FIG. 3 is a front elevation view of a pair of trousers in accordance with one embodiment of the present invention.

FIG. 4 is a detailed cross-sectional view of a portion of a pair of trousers shown in FIG. 3.

DETAILED DESCRIPTION OF THE PREFERRED EMBODIMENT

The following presents a detailed description of one embodiment of the present invention, which is presently considered to be the best mode of the present invention.

Referring to the accompanying Figures, FIG. 1 shows a jacket 1 prepared in accordance with the present invention. Jacket 1 contains torso portion 2 and arm portions 3. Torso portion 2 contains collar edge 4, closure edge 5 and bottom edge 6. Arm portions 3 contain respective edge portions 7.

The jacket comprises outer layer 8 and inner layer 9. Outer layer 8 comprises a flame resistant and abrasion resistant material, such as Nomex Duck or Twill Weave. The outer layer contains a major portion and a minor portion. The minor portion comprises the portion(s) adjacent the terminal edges of the garment. In the case of a jacket, the minor portion may include the bottom edge portion 10 (delineated by dotted line 10*a*) and/or arm edge portions 13 (delineated by dotted line 13*a*) . The dimensions of these portions is limited only by the feasibility of making the corresponding portion of the inner layer large enough to extend far enough from the edge of the outer layer to economically perform its function while leaving the balance (and major portion) of the garment free to be removed from the outer layer as described below. Typical delineation of the minor portion of the outer layer is at from about 1 to 6 inches from the terminal edge(s) of the garment.

Inner layer 9 comprises a moisture barrier material such as Goretex and a thermal insulative layer such as Nomex Duck or Twill Weave. The inner layer 9 is divided into a minor portion, such as 9*a*, and a major portion, such as 9*b*. The minor portion of the inner layer is permanently attached beneath the corresponding minor portion of the outer layer. This is done such as by stitching as shown with respect to the attachment of portion 9*a* to the outer layer by stitching 14. The major portion of the inner layer is releasably attached beneath the major portion of the outer layer, such as by snaps, such as 15 and others (not shown).

FIG. 2 shows a cross-sectional view of a portion of the jacket shown in FIG. 1. This view further shows how minor and major portions of the inner layer (9*a* and 9*b*, respectively) are releasably attached to one another, and how the minor portion of the inner layer is permanently attached to the outer layer. This view also shows how the minor and major portions may be made to overlap at their interface to maintain the thermal insulation and moisture barrier qualities of the liner.

A pair of trousers may also be prepared for use with or with out an accompanying jacket. Such a pair of trousers may have constructions similar to that shown in FIGS. 1 and 2 at the leg portion edges.

FIG. 3 shows a pair of trousers 20 in accordance with the present invention. Trousers 20 contains torso portion 21 and leg portions 22. Leg portions 21 contain respective edge portions 23.

The trousers comprise outer layer 24 and inner layer 25. Outer layer 24 comprises a flame resistant and abrasion resistant material, such as Nomex® Duck or Twill Weave. The outer layer contains a major portion and a minor portion. The minor portion comprises the portions adjacent the terminal edges of the garment. In the case of a pair trousers, the minor portion includes the leg edge portions 23 (delineated by dotted line 23*a*). The dimensions of these portions is limited only by the feasibility of making the corresponding portion of the inner layer large enough to extend far enough from the edge of the outer layer to economically perform its function while leaving the balance (and major portion) of the garment free to be removed from the outer layer as described below. Typical delineation of the minor portion of the outer layer is at about one to six inches from the terminal edge of the trousers.

Inner layer 25 comprises a moisture barrier material such as Gore-tex® and a thermal insulative layer such as Nomex® Duck or Twill Weave. The inner layer 25 is divided into a minor portion, such as 25*a*, and a major portion, such as 25*b*. The minor portion of the inner layer is permanently attached beneath the corresponding minor portion of the outer layer. This is done such as by stitching as shown with respect to the attachment of portion 25*a* to the outer layer by stitching in the same fashion as is shown with respect to the jacket in FIG. 1. The major portion of the inner layer is releasably attached beneath the major portion of the outer layer, such as by snaps, such as 26 and others (not shown).

FIG. 4 shows a cross-sectional view of a portion of the trousers shown in FIG. 3. This view further shows how minor and major portions of the inner layer (25*a* and 25*b*, respectively) are releasably attached to one another, and how the major portion of the inner layer is permanently attached to the outer layer. This view also shows how the minor and major portions may be made to overlap at their innerface to maintain the thermal insulation and moisture barrier qualities of the liner.

The construction of the present invention may be provided in a protective garment to a greater or lesser extent, as desired. That is, the construction of the present invention may be applied for instance to the torso portion of a jacket only, leaving the sleeves with a conventional, permanently attached inner layer. A protective suit might also be constructed with a jacket containing both torso and sleeve portions in accordance with the present invention while using a pair of trousers of a conventional construction.

In light of the foregoing disclosure, it will be within the ability of one of ordinary skill in the garment-making art to make modifications, alterations and the substitution of equivalent materials and dimensions so as to be able to practice the present invention as defined by the accompanying claims, without departing from the spirit of the invention.

What is claimed is:

1. A firefighter's jacket, comprising:

a) an outer layer having a torso portion and arm portions, said torso portion having a terminal edge area at the periphery thereof and said arm portions each having a terminal edge area at the ends thereof;

b) an inner layer comprising a thermal insulative material and having a torso portion and arm portions, said torso portion of the inner layer having a major portion and a minor portion and said arm portions of the inner layer having a major portion and a minor portion;

c) means for permanently fixing; 1) said minor portion of said torso portion of the inner layer to the terminal edge area of the torso portion of the outer layer, and 2) said minor portions of said arm portions of the inner layer to the terminal edge areas of the arm portions of the outer layer; and d) means for releasably securing: 1) the major portion of the torso portion of the inner layer to the minor portion of the torso portion of the inner layer, and 2) the major portions of the arm portions of the inner layer to the minor portions of the arm portions of the inner layer, said means for releasably securing allowing the major and minor portions to be repeatedly released and reattached from one another without destroying the structural integrity of the jacket.

2. The firefighter's jacket according to claim 1, wherein said means for releasably securing consists of snaps.

3. The firefighters garment according to claim 1, wherein said means for releasably securing consists of hook and loop closures.

4. The firefighters garment according to claim 1, wherein said means for releasably securing consists of zippers.

5. The firefighters garment according to claim 1, wherein said means for releasably securing consists of releasable adhesive.

6. A firefighter's jacket according to claim 1 wherein said outer layer comprises a flame resistant and abrasion resistant material.

7. A firefighter's jacket according to claim 1 wherein said inner layer comprises a moisture barrier material and a thermal insulative material.

* * * * *